US005546679A

United States Patent [19]

Keller

[11] Patent Number: 5,546,679

[45] Date of Patent: Aug. 20, 1996

[54] INSTALLATION FOR THE THERMAL DRYING OF STRIPS, SHEETS, ETC., OF MATERIAL

[75] Inventor: Alfred Keller, Leinfelden-Echterdingen, Germany

[73] Assignee: Weitmann & Konrad GmbH & Co., Leinfelden-Echterdingen, Germany

[21] Appl. No.: 362,463

[22] Filed: Jan. 3, 1995

[30] Foreign Application Priority Data

Oct. 26, 1992 [DE] Germany ..... 9214459 U

[51] Int. Cl.[6] ..... F26B 3/34

[52] U.S. Cl. ..... 34/278; 34/62; 34/267

[58] Field of Search ..... 34/62, 179, 275, 34/276, 277, 278, 266, 267

[56] References Cited

U.S. PATENT DOCUMENTS

| | | | |
|---|---|---|---|
| 3,745,307 | 7/1973 | Peek, Jr. et al. | 34/278 |
| 3,967,385 | 7/1976 | Culbertson | 34/277 |
| 4,015,340 | 4/1977 | Treleven | 34/278 |
| 4,143,278 | 3/1979 | Koch, II | 34/278 |
| 4,168,579 | 9/1979 | Ericsson | 34/46 |
| 4,449,453 | 5/1984 | Staffer et al. | 34/62 |
| 4,501,072 | 2/1985 | Jacobi, Jr. et al. | 34/267 |
| 4,646,446 | 3/1987 | Bubley | 34/278 |
| 4,773,167 | 9/1988 | Jacobi, Jr. | 34/4 |
| 4,843,734 | 7/1989 | Varwig | 34/62 |
| 5,038,495 | 8/1991 | Jacobs et al. | 34/62 |
| 5,343,629 | 9/1994 | Rae | 34/278 |

FOREIGN PATENT DOCUMENTS

| | | | |
|---|---|---|---|
| 0078382 | 5/1983 | European Pat. Off. | B41F 23/04 |

*Primary Examiner*—John M. Sollecto
*Assistant Examiner*—Steve Gravini
*Attorney, Agent, or Firm*—Dick and Harris

[57] ABSTRACT

An installation for the thermal drying of strips, sheets, etc., which are conveyed along a path over guide elements past dryer unit in a drying device. The installation has a cooling unit whose coolant is fed through suitable coolant lines to the guide elements in the drying zone and to the dryer units, from where the coolant is fed to a heat exchanger. The installation also has an air extractor to extract the air from the drying zone. In order to provide a space saving installation, the heat exchanger in the cooling unit is located in the vicinity of the air-extraction aperture of the air extractor, adjacent to the drying zone.

18 Claims, 3 Drawing Sheets

INSTALLATION FOR THE THERMAL DRYING OF STRIPS, SHEETS, ETC., OF MATERIAL

BACKGROUND OF THE INVENTION

1. Field of the Invention

This invention concerns a device for thermal drying of webs, sheets, etc., of materials that are conveyed along a conveyor path over guide elements that are provided in the vicinity of dryer elements of a dryer unit.

2. The Prior Art

Known dryers that are used with modern printing machines for accelerating the drying of printing inks work with infrared heat sources for example which have radiant reflectors and baffles to guide the sheets opposite them. Such IR dryers work with IR heat sources having a working temperature of about 900° C. on the glass surface of the lamp, so the dryer must then be cooled with a suitable coolant such as water containing antifreeze. Then the heat is removed from the coolant, which has been heated up in the area of the dryer, in a suitable heat exchanger. Electric power supply and control equipment or switchgear and suitable cooling equipment are necessary for the coolant. This equipment must be set up next to the machine or at a distance from it. An arrangement of control panels and cooling equipment that takes up a lot of space next to the machine is often impossible in a printing room, so then it is necessary to rely on arrangements that do not require long supply lines and coolant lines.

It is already known that residual heat and air can be vented from the area of the dryer by providing a exhaust fan at the end of the printing machine.

SUMMARY OF THE INVENTION

This invention is based on the problems of providing another device for thermal drying according to the generic concept that will especially permit a space-saving installation.

The heat exchanger of the cooling equipment for the dryer unit according to this invention is set up in the air intake area of the air exhaust equipment with which air and residual heat are removed from the area of the dryer. With this very compact design which makes it possible to avoid long coolant lines, it is possible to achieve adequate cooling of the coolant, although the air exhausted from the area of the dryer is hotter than the ambient air. For effective cooling of the coolant, it is sufficient if there is a definite temperature difference between the coolant and the heat exchanger and the air flowing around the heat exchanger.

It has been found in particular that the hot air at a temperature of approximately 35°–40° C. from the area of the dryer is completely adequate to cool the coolant returning from the dryer to a temperature of about 8° C. above ambient temperature in the heat exchanger, and a coolant cooled in this way has a much lower temperature than the baffle plate to be cooled or the radiant reflector of the IR dryer.

The arrangement according to this invention of the heat exchanger with the air exhaust equipment that is required with printing machines yields not only an especially compact arrangement but also makes it possible to eliminate the need for a separate cooling fan etc., for the cooling equipment at the same time.

Due to the combined arrangement of the air exhaust equipment and the operating and control equipment of the cooling system in a separate housing, the add-on housing, the function groups required for cooling the dryer unit can be arranged in a modular fashion. Consequently, the individual operating components can be preassembled at the plant and tested for satisfactory operation from the standpoint of quality assurance, so only the dryer unit and the power supply module—in other words, the add-on housing with the air exhaust and cooling equipment—need be assembled and mounted on the printing machine at the installation site. This permits rapid, customer-friendly installation owing to short on-site assembly times for the components.

In order to compensate for any changes in volume in the coolant circuit, a balancing tank is provided in the coolant circuit is likewise arranged in the add-on housing and thus supplements the functions accommodated in the power supply module.

The design may be configured in order to protect the components arranged in the add-on housing from the heated air with its high solvent vapor content exhausted from the area of the dryer, which also contains fine powder dust if an atomizer station is provided downstream from the dryer. This not only makes it possible to protect the various components arranged in the add-on housing from hot air and impurities but it also assures an effective air exhaust because satisfactory air flow is assured by means of the add-on housing.

The space in the add-on housing can be used to accommodate other supply equipment because the air flow in the air exhaust equipment is not affected by the design of the add-on housing. This also facilitates easy adaptation of the add-on housing to the machine housing—in other words, the design of the add-on housing can also be adapted to the aesthetic design of the machine housing (in addition, to technical aspects) without sacrificing technical advantages.

An electric power supply unit can also be accommodated in the add-on housing. Such a unit may have electric and/or electronic power supply and control equipment for the device according to this invention. The shielding of the electric power supply unit from the hot air ladeen with solvent vapors is especially important. The operating elements for the device according to this invention are preferably arranged on the add-on housing.

In the case of printing machines that can be operated by remote control from a control panel set up at a distance, the individual operating and display elements of the device are also arranged on the control panel of the control stand. In this case only control lines that are relatively simple to install are needed.

DETAILED DESCRIPTION OF THE DRAWINGS

In the various drawings in the figures, corresponding components are labeled with the same reference numbers.

Figure 1:
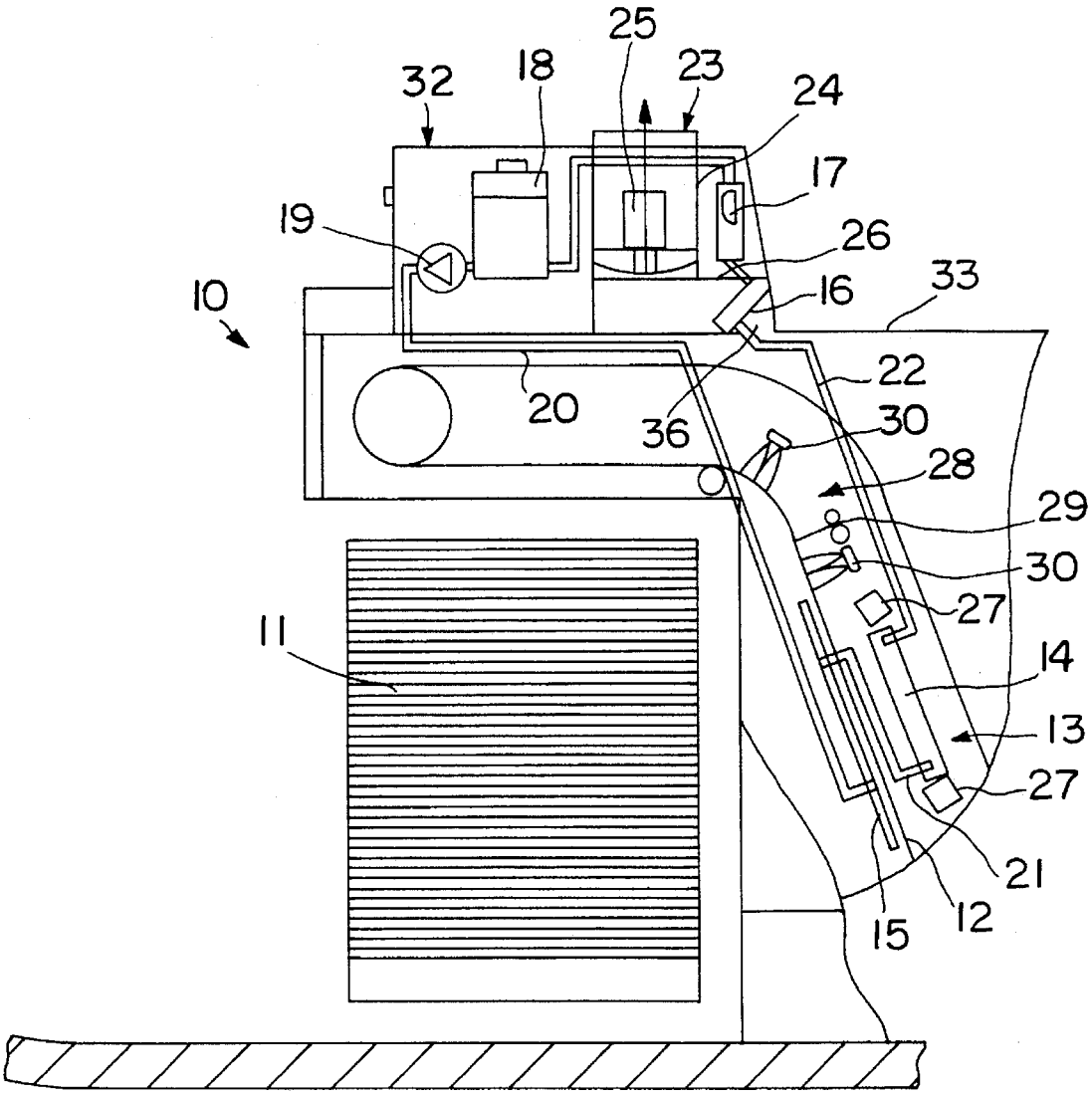
FIG. 1 shows a schematic diagram in the form of a cross section through a device for thermal drying that is arranged on a printing machine.

FIG. 1 shows in purely schematic form the feed mechanism 10 of a sheet-fed offset printing machine, where the individual printed sheets are delivered in a stack 11. The printed sheets are guided along a conveyor path 12 by a corresponding conveyor device.

The conveyor path 12 has a dryer unit 13 that is designed as an IR radiant heat dryer, for example, and has a radiant heat reflector 14 to reflect the infrared radiant heat generated by IR lamps (not shown in FIG. 1) to the sheets of paper passing by the dryer unit 13 along conveyor path 12. A guide plate 15 for the sheets of paper is provided on the side of the conveyor path 12 facing away from the radiant heat reflector 14 as a guide element for the printed sheets.

A cooling device with a heat exchanger 16 a flow monitor 17, a balancing tank 18 for a coolant and a circulating pump 19 is provided for cooling the dryer unit 13. A coolant line 20 leads from circulating pump 19 to the page guide plate 15 around which coolant flows. The coolant outlet from the page guide plate 15 is connected by connecting line 21 to the radiant heat reflector 14 so coolant can also flow through it. The coolant outlet side of the radiant heat reflector 14 is connected by a return line 22 to the coolant inlet of heat exchanger 16 whose outlet is in turn connected by way of the flow monitor 17 to the balancing tank 18 to which the circulating pump is also connected.

In this way a closed coolant circuit is achieved within an open cooling system.

In order to remove residual heat and solvent vapors from the area of the dryer, an air exhaust device 23 having tube axial fans 25 arranged in an exhaust air connection 24 is provided. The exhaust air connection 24 is arranged on a connected housing 26 in whose air inlet area 36 which extends across the conveyor path 12 for the printed sheets heat exchanger 16 of the cooling equipment is arranged.

Cooling equipment is provided with two thermostats (not shown) which monitor the temperature of the coolant. One thermostat controls the after-running of the fan 25 in order to prevent heat from building up after the dryer is shut down. The other thermostat switches off the dryer unit 13 when the coolant has absorbed the maximum amount of heat in accordance with its thermal capacity.

Dryer unit 13 is also provided with an air doctor blade whose air jets 27 extend over the width of the conveyor path 12 and are arranged upstream and downstream from the radiant heat reflector 14 in the direction of conveyance.

Downstream from the dryer unit 13 as seen in the direction of conveyance of the sheets of paper, an atomization device 28 with atomizer nozzles 29 and ionization rods 30 may also be provided.

Figure 2:
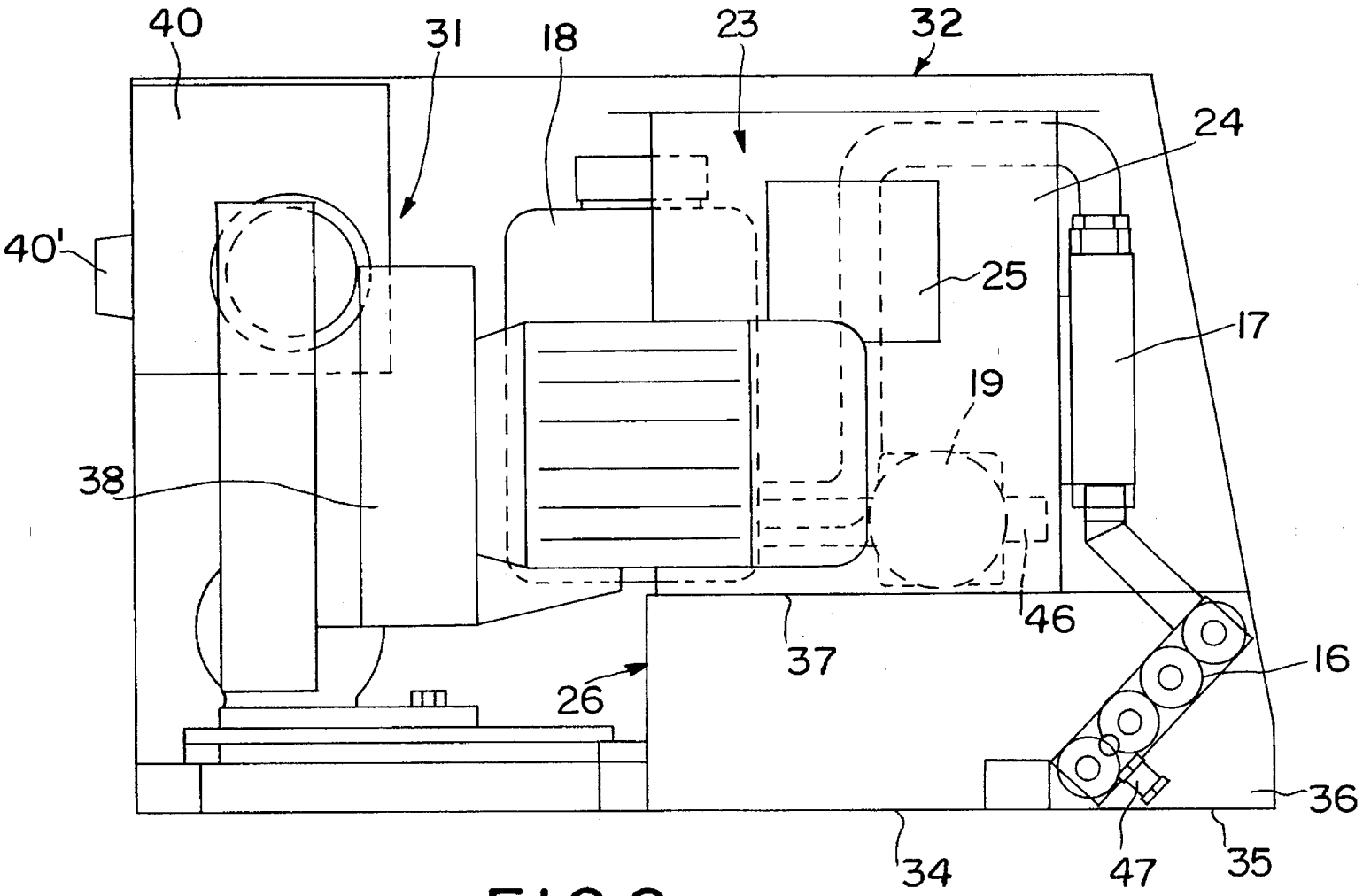
FIG. 2 shows a schematic section through a power supply module of the device according to FIG. 1.
Figure 3:
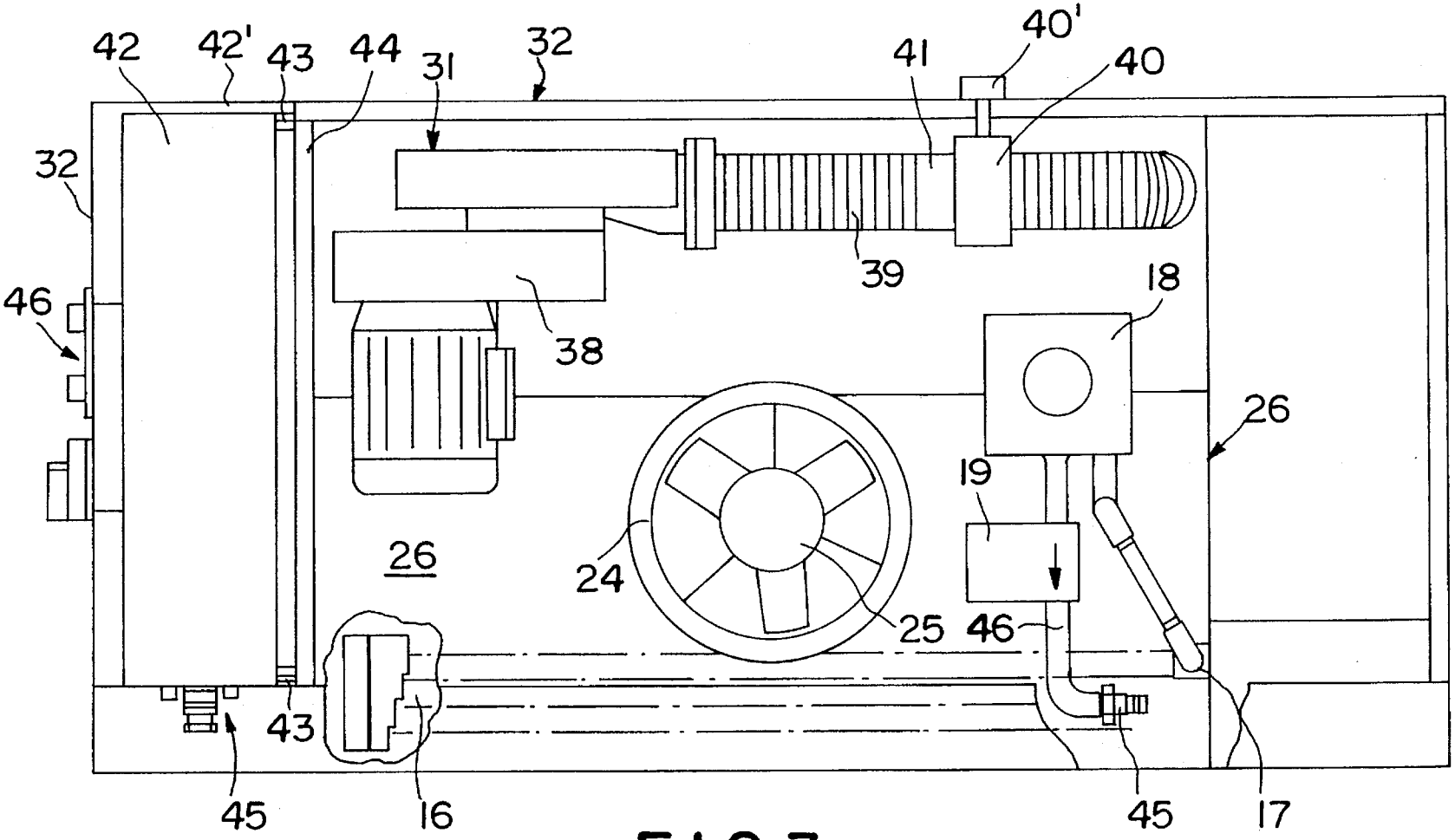
FIG. 3 shows a top view of the power supply module of the device according to FIG. 1 without a cover plate.

As shown especially well in FIGS. 2 and 3, the cooling equipment 23 with its heat exchanger 16, the flow monitors 17, the balancing tank 18 and the circulating pump 19 is arranged together with the air exhaust equipment 23 and a fan arrangement 31 to supply the air doctor blow jets 27 in an add-on housing 32 that is mounted on the machine housing 33 in the area of the feed unit 10 of the offset printing machine.

The add-on housing 26 of the air intake equipment is designed so it is essentially cubical and has an essentially rectangular orifice 35 extending over the width of conveyor path 12 in the bottom wall 34. This rectangular orifice corresponds to a similar orifice in the machine housing 33 and establishes an air intake area 36. The exhaust air connection 24 is arranged on the cover wall 37 of the add-on housing 26 with the tube axial fan 25 arranged approximately in the middle. Thus the essentially rectangular cross section of the air intake area 36 is adapted by the connecting housing 26 to the relatively small round cross section of the tube axial fan 25 or the exhaust air connection 24.

The fan arrangement 31 for supplying air to the air doctor blow jets 27 has a fan 38 that is connected by a hose line 39 to an air flow regulator 40 that has an operating element 40' arranged on an outside wall of the add-on housing 32 in such a way that it is accessible from the outside. A connecting element 41 that can be connected to the blow jets 27 by way of corresponding lines in a manner that is not shown in detail here is provided for connecting the blow jets 27 for the air doctor blade. In order to be able to supply the air doctor blow jets 27 with hot air if necessary, a heating element (not shown) may also be installed in the add-on housing upstream or downstream from the fan 38.

In addition, an electric power supply unit 42 whose housing 42' is attached by means of appropriate connecting elements 43 to a partition or a reinforcing wall 44 of the add-on housing 32 is also arranged in the add-on housing 32. The partition or reinforcing wall 44 also serves to provide thermal separation between the electric power supply 42 and the other units arranged in the add-on housing 32. The electric power supply unit 42 which contains a main switch, a motor safety switch as well as all the required fuses and electronic control circuits in a manner that is not shown here has a connecting device 45 for the power supply lines and control lines as well as an operating unit 46 with corresponding operating and display elements that are arranged outside on a side wall 32' of the add-on housing 32.

Thus a power supply module for the dryer unit has been created that can be preassembled at the factory and tested for all operating functions.

Assembly of the device according to this invention for thermal drying is carried out as follows:

The air exhaust device 23, the cooling unit with the heat exchanger 16, the flow monitor 17, the balancing tank 18 and the circulating pump 19 as well as the fan arrangement 31 for the blow jets 27 of the air doctor blade are completely preassembled at the factory in the add-on housing 32. In doing so, the electric power supply unit 42 is also completely wired electrically at the factory. Accordingly, the connections for the cooling medium and air are preinstalled and ready for installation and have been tested for leakage and for proper operation. The sheet guide plate 15, the radiant heat reflector 14 with the IR lamps and optionally the blow jets 27 for the air doctor blade are to be mounted on the printing machine. In addition, the coolant line 20, connecting line 21 and return line 22 are also installed.

Next, the power supply module together with the add-on housing 32 is mounted on the machine housing 33, in which case the coolant line 20 is connected to a connecting element 45 that is mounted on an outlet line 46 of a circulating pump 19. The return line 22 for coolant is connected to a connection 47 on heat exchanger 16. If present, the blow jets 27 of the air doctor blade are connected by a connecting line (not shown) to the connection element 41 on the air flow regulator of the fan device 31. Furthermore, the electric connection lines for the IR lamps of the dryer unit 13 are also connected then.

In addition, the exhaust air connection 24 is connected to a suitable exhaust air line in which filters may optionally also be arranged.

Finally the cooling unit is filled with coolant as usual.

In operation of the device described here for drying printed sheets of paper, the sheets are guided through the dryer area along the conveyor path while they are heated by infrared radiation in order to accelerate the oxidative drying of the printing inks. Due to the cooling of the sheet guide plate 15 and the radiant heat reflector 13 [sic; 14] a build up of heat inside the printing machine is prevented. Water mixed with antifreeze and/or corrosion inhibitors is the preferred coolant for cooling in this system and first flows through the cooler sheet guide plate 15 and then flows through the hotter radiant heat reflector 14. Then the coolant is guided passed the heat exchanger, while the flow monitor 17 arranged downstream from it constantly monitors the operation of the cooling circuit.

In order to remove the residual heat generated in the drying area while at the same time removing air latent with solvent vapors, the air is removed with the air exhaust device 23 and vented through corresponding exhaust air lines. The air removed from the area of the dryer flows through the heat exchanger 16 which is designed as an air-water heat exchanger and is used in this way to cool the coolant. If an atomizer 26 is arranged downstream from the dryer unit 13, excess powder is also removed with the exhausted air at the same time, thus reducing unwanted soiling of the printing machine and eliminating exposure of the operating personnel to powder dust and solvent vapors.

What is claimed is:

1. Device for thermal drying of webs of material, including a dryer unit (13), having dryer elements (14), wherein the webs are conveyed along a conveyor path (12) over guide elements (15) that are provided in the vicinity of the dryer elements (14) of the dryer unit (13), with a cooling unit (16, 17, 18, 19) whose coolant is sent to the guide elements (15) in the dryer unit and to dryer elements (14) and from there onto a heat exchanger (16) and with an air exhaust device (23), having an air intake area (36), for venting the air from the area of the dryer, characterized in that the heat exchanger (16) of the cooling unit is arranged in the air intake area (36) of the air exhaust device that is connected to the dryer unit.

2. Device according to claim 1, characterized in that the air exhaust equipment (23) is arranged in an add-on housing (32) that is mounted on a machine housing (33) that surrounds the conveyor path (12) of the drying elements (14).

3. Device for thermal drying of webs of material, including a dryer unit (13), having dryer elements (14), wherein the webs are conveyed along a conveyor path (12) over guide elements (15) that are provided in the vicinity of the dryer elements (14) of the dryer unit (13, with a cooling unit (16, 17, 18, 19) whose coolant is sent to the guide elements (15) in the dryer unit and to dryer elements, (14) and from there onto a heat exchanger (16) and with an air exhaust device (23), having an air intake area (36), for venting the air from the area of dryer, characterized in that the heat exchanger (16) of the cooling unit is arranged in the air intake area (36) of the air exhaust equipment that is connected to the dryer unit, the air exhaust device being arranged in an add-on housing (32) that is mounted on a machine housing (33) that surrounds the conveyor path (12) of the dryer elements (14), and wherein the heat exchanger (16) of the cooling unit is arranged in the add-on housing.

4. Device according to claim 1, characterized in that the cooling unit has a coolant circuit with a circulating pump (19) that is arranged in the add-on housing (32) together with other operating and monitoring devices (18, 17) of the cooling unit for the coolant circuit.

5. Device according to claim 4, characterized in that detachable line connectors (45, 47) are arranged in the coolant lines (46, 20 and 22) that lead away from the circulating pump (19) and lead back to the heat exchanger (16) where these line connectors are arranged in the transitional area between the add-on housing (32) and the machine housing (33).

6. Device according to claim 4, characterized in that a flow monitor (17) that is arranged in the add-on housing (32) is provided in the coolant circuit in the heat exchanger (16) and the circulating pump (19).

7. Device according to claim 4, characterized in that a balancing tank (18) for coolant is provided in the add-on housing (32) between the heat exchanger (16) and the circulating pump (19) in the coolant circuit.

8. Device for thermal drying of webs of material, including a dryer unit (13), having dryer elements (14), wherein the webs are conveyed along a conveyor path (12) over guide elements (15) that are provided in the vicinity of the dryer elements (14) of the dryer unit (13), with a cooling unit (16, 17, 18, 19) whose coolant is sent to the guide elements (15) in the dryer unit and to dryer elements (14) and from there onto a heat exchanger (16) and with an air exhaust device (23), having an air intake area (36), for venting the air from the area of the dryer, characterized in that the heat exchanger (16) of the cooling unit is arranged in the air intake area (36) of the air exhaust device that is connected to the dryer unit, and wherein the exhaust device has an add-on housing in whose air intake area (36) the heat exchanger (16) is arranged and to which a fan (25) is connected at its intake side.

9. Device according to claim 8, characterized in that the add-on housing (26) has an air intake area (35, 36) that is preferably rectangular and extends essentially over the entire width of the conveyor path (12), and is covered essentially by the heat exchanger (16).

10. Device according to claim 8, characterized in that the fan (25) is arranged across the conveyor path at (12), approximately at the middle of the add-on housing (26).

11. Device according to claim 8, characterized in that the fan is designed as a tube axial fan (25) and is provided in the exhaust air connection (24) connected directly to the add-on housing (26).

12. Device according to claim 2, characterized in that the dryer unit (13) is provided with an air doctor blade whose blow jets (27) are connected to a fan (38) arranged in the add-on housing (32) by means of corresponding lines, and the lines leading to the blow jets (27) are preferably operably connected to the fan (38) preferably in the transitional area between the add-on housing (32) and the machine housing (33).

13. Device according to claim 12, characterized in that an air flow regulator (40) is provided for the fan (38) of the air doctor blade and is arranged in the add-on housing (32) between the fan (38) and the connecting elements (41) for the lines leading to the blow jets (27).

14. Device according to claim 13, characterized in that an operating element (40') for the air flow regulator (40) is arranged on the add-on housing (32) in such a way that it is accessible from the outside.

15. Device according to claim 2, characterized in that a power supply and control system is provided in the add-on housing (32) for the electric power supply unit (42) including the air exhaust device (23) the cooling unit, the drying unit (13) and/or the air doctor fan (38).

16. Device according to claim 3, characterized in that the operating elements for at least one of the air exhaust unit (23), the cooling unit, the drying unit (13) and the air doctor blade fan (38) are arranged in the area of the electric power supply unit (32) on the add-on housing (32).

17. Device according to claim 3, characterized in that the control and display devices for at least one of the air exhaust unit (23), the cooling unit, the drying unit (13) and the air doctor blade fan (38) are arranged in the area of the electric power supply unit (32) on the add-on housing (32).

18. Device according to claim 3, characterized in that at least one of the operating elements, and the control and display devices, for at least one of the air exhaust unit (23), the cooling unit, the drying unit (13) and the air doctor blade fan (38) are arranged in the area of the electric power supply unit (32) on the add-on housing (32).

* * * * *

UNITED STATES PATENT AND TRADEMARK OFFICE

CERTIFICATE OF CORRECTION

PATENT NO. : 5,546,679
DATED : August 20, 1996
INVENTOR(S) : Keller

It is certified that error appears in the above-indentified patent and that said Letters Patent is hereby corrected as shown below: On the title page:

In item [22], after "filed;" delete Jan. 3, 1995 and insert instead -- October 9, 1993 --.

Signed and Sealed this

Second Day of December,1997

*Attest:*

Bruce Lehman

BRUCE LEHMAN

*Attesting Officer*

*Commissioner of Patents and Trademarks*